US005829523A

United States Patent [19]

North

[11] Patent Number: 5,829,523

[45] Date of Patent: Nov. 3, 1998

[54] PRIMARY WELL CEMENTING METHODS AND APPARATUS

[75] Inventor: John C. North, Port Elphinstone, United Kingdom

[73] Assignee: Halliburton Energy Services, Inc., Duncan, Okla.

[21] Appl. No.: 828,865

[22] Filed: Mar. 31, 1997

[51] Int. Cl.[6] ..... E21B 33/16; E21B 47/00

[52] U.S. Cl. ..... 166/250.14; 73/152.18; 166/155; 166/291

[58] Field of Search ..... 166/250.01, 250.14, 166/285, 291, 153, 155; 73/152.01, 152.18

[56] References Cited

U.S. PATENT DOCUMENTS

| | | | |
|---|---|---|---|
| 2,630,179 | 3/1953 | Brown | 166/291 |
| 3,635,288 | 1/1972 | Lebourg | 166/291 X |
| 3,796,260 | 3/1974 | Bradley | 166/153 |
| 4,571,993 | 2/1986 | St. Onge | 166/250.14 X |
| 4,624,312 | 11/1986 | McMullin | 166/155 |
| 4,809,776 | 3/1989 | Bradley | 166/153 |
| 4,819,726 | 4/1989 | Beirute et al. | 166/291 |
| 5,095,988 | 3/1992 | Bode | 166/291 |
| 5,199,489 | 4/1993 | Johnson et al. | 166/291 X |
| 5,323,858 | 6/1994 | Jones et al. | 166/291 |
| 5,392,852 | 2/1995 | Laurel et al. | 166/153 |
| 5,413,172 | 5/1995 | Laurel | 166/153 |
| 5,722,491 | 3/1998 | Sullaway et al. | 166/291 |

*Primary Examiner*—George Suchfield
*Attorney, Agent, or Firm*—Craig W. Roddy; C. Clark Dougherty, Jr.

[57] ABSTRACT

The present invention provides improved primary well cementing methods and apparatus. The methods basically comprise the steps of releasing a displacement plug into the casing to be cemented and pumping a first displacement fluid behind the displacement plug while measuring the quantity of the first displacement fluid required to land the displacement plug on a float collar or the like connected near the bottom of the casing, releasing a bottom cementing plug into the casing and pumping a cement slurry behind the bottom cementing plug in a predetermined quantity and then releasing a top cementing plug into the casing and pumping a second displacement fluid behind the top cementing plug in a quantity substantially equal to the measured quantity of the first displacement fluid thereby ensuring that the cement slurry is not under or over displaced in the annulus between the casing and the well bore.

16 Claims, 2 Drawing Sheets

PRIMARY WELL CEMENTING METHODS AND APPARATUS

BACKGROUND OF THE INVENTION

1. Field of the Invention

The present invention provides improved primary well cementing methods and apparatus, and more particularly, improved methods and apparatus for cementing casing and liners in well bores.

2. Description of the Prior Art

In cementing casing or liners (both referred to hereinafter as "casing") in well bores (known as primary cementing), a cement slurry is pumped downwardly through the casing to be cemented and then upwardly into the annulus between the casing and the walls of the well bore. Upon setting, the cement bonds the casing to the walls of the well bore and restricts fluid movement between formations or zones penetrated by the well bore.

Prior to a primary cementing operation, the casing is suspended in a well bore and both the casing and the well bore are usually filled with drilling fluid. In order to reduce contamination of the cement slurry at the interface between it and the drilling fluid, a cementing plug for sealingly engaging the inner surfaces of the casing is pumped ahead of the cement slurry whereby the cement slurry is separated from the drilling fluid as the cement slurry and drilling fluid ahead of it are displaced through the casing. The cementing plug wipes the drilling fluid from the walls of the casing and maintains a separation between the cement slurry and drilling fluid until the plug lands on a float collar attached near the bottom end of the casing.

The cementing plug which precedes the cement slurry and separates it from drilling fluid is referred to herein as the "bottom plug." When the predetermined required quantity of the cement slurry has been pumped into the casing, a second cementing plug, ref erred to herein as the "top plug", is released into the casing to separate the cement slurry from additional drilling fluid or other displacement fluid used to displace the cement slurry.

When the bottom plug lands on the float collar attached to the casing, a valve mechanism opens which allows the cement slurry to proceed through the plug and the float collar upwardly into the annular space between the casing and the well bore. The design of the top plug is such that when it lands on the bottom plug it shuts off fluid flow through the cementing plugs which prevents the displacement fluid from entering the annulus. After the top plug lands, the pumping of the displacement fluid into the casing is often continued whereby the casing is pressured up and the casing and associated equipment including the pump are pressure tested for leaks or other defects.

When the volume of the displacement fluid utilized for displacing the cement slurry down the casing and into the annulus is incorrect, over displacement or under displacement of the cement slurry occurs. When the cement slurry is over displaced into the annulus, a bottom portion of the casing is not cemented in the well bore. As a result, when drilling is resumed below the cemented casing, one or more of the casing joints making up the uncemented portion of the casing may be unthreaded and disconnected from the cemented casing. This and other failures of the casing due to defective cementing can result in the necessity for the implementation of very costly and time consuming remedial procedures. When the cement slurry is under displaced whereby a portion of the cement slurry remains inside the casing, an upper portion of the casing is not cemented in the well bore and costly extra drilling is required to drill out the excess cement within the casing. Also, when the cement slurry is under displaced, the top cementing plug does not land on the float collar and pressure testing of the casing can not be accomplished without setting a packer for that purpose. The setting of a packer increases the time required for pressure testing and adds appreciable cost to the drilling operation. Also, the practice of setting a packer and testing may damage the casing, especially if high pressures are applied.

The exact volume of displacement fluid required to land the top cementing plug on the float collar and displace the correct quantity of cement slurry into the annulus is generally very difficult to determine. The reason for this is that the exact size of the casing string is not always known or the manufactured size can be incorrect. In the drilling of deep wells, the exact volume of displacement fluid required is often difficult to calculate due to the compressibility of the drilling fluid. Also, the technique used to measure the volume of the displacement fluid as the cement slurry is displaced into the annulus is often inaccurate. For example, one commonly used technique is to count the strokes of the pump used to pump the displacement fluid and then multiply the number of strokes by a theoretical volume per stroke. This technique is highly subject to error and is often inaccurate.

Because of the substantial risk of over displacement of the cement slurry and the consequences thereof, most drilling rig operators utilize a float shoe at the bottom of the casing to be cemented and a float collar above the float shoe with a relatively long length of casing in between. The casing between the float collar and the float shoe is referred to in the art as the "shoe track." The displacement fluid volume utilized is based on a theoretical volume to cause the top cementing plug to reach the float collar plus 50% of the volume of the shoe track. This technique often leaves a significant amount of extra cement in the shoe track and sometimes in the casing above the shoe track which must be drilled out. However, the operators prefer to drill out extra cement than run the risk of over displacement and the consequences it causes. Also, in an abundance of caution, some operators have increased the length of the shoe track from a nominal length of from about 40 to 80 feet to a length as great as 300 feet. This causes more time to be spent drilling a longer shoe track full of set cement which itself can cause damage to the casing.

Thus, there is a need for improved methods and cementing plug apparatus whereby the correct cement slurry displacement fluid volume can be reliably and accurately determined prior to displacing the cement slurry in a primary cementing operation.

SUMMARY OF THE INVENTION

The present invention provides improved methods and cementing plug apparatus which meet the needs described above and overcome the deficiencies of the prior art. The methods of the invention basically comprise releasing a closed displacement plug into the casing which is selectively openable after landing on a float collar. A first displacement fluid is then pumped behind the closed displacement plug while measuring the quantity of the first displacement fluid being pumped until the displacement plug is displaced through the casing and lands on a float shoe contained in the casing. The displacement plug is caused to open, and a cement slurry is pumped into the casing in a predetermined quantity required to fill the annulus between the exterior of the casing and the walls of the well bore with the cement slurry. After the predetermined quantity of cement slurry is pumped into the casing, a top cementing plug is released into the casing. A second displacement fluid is then pumped behind the top cementing plug to displace the cement slurry through the casing and through the open displacement plug into the annulus. The second displacement fluid is pumped in a quantity substantially equal to the quantity of the first displacement fluid as measured during the displacement of the displacement plug thereby ensuring that the cement slurry is not under or over displaced in the annulus.

Cementing plug apparatus are also provided which include a selectively releasable displacement plug in addition to a bottom cementing plug and a top cementing plug.

It is, therefore, a general object of the present invention to provide improved primary cementing methods and apparatus.

A further object of the present invention is the provision of methods and apparatus for primary cementing whereby the risk of under or over displacing the cement slurry is eliminated.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figures 1A, 1B, 1C, 1D:
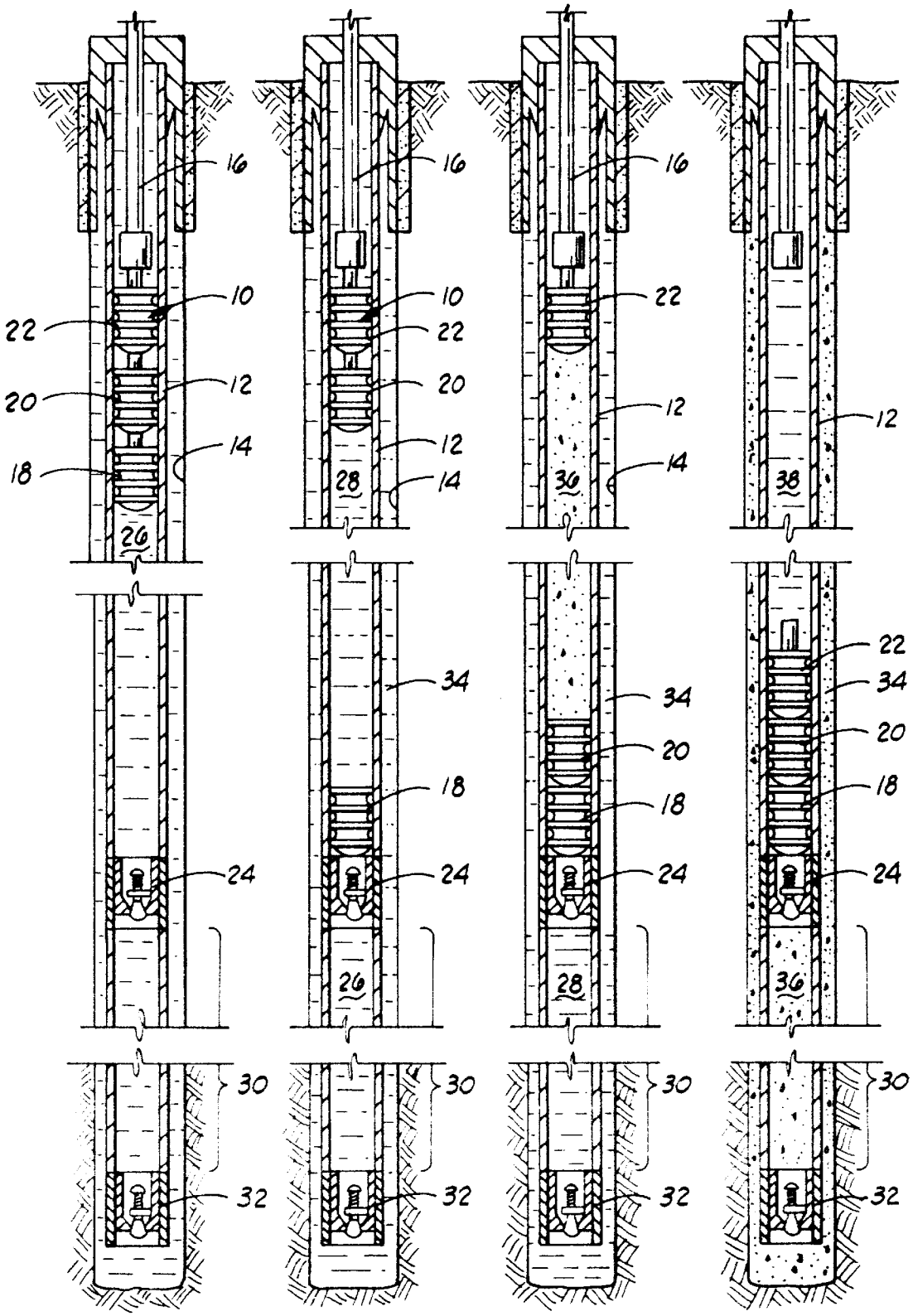
FIG. 1A is a side cross-sectional view of a well bore and a casing to be cemented therein having a cementing plug assembly of the present invention installed in its initial position in the casing.
FIG. 1B is a view similar to FIG. 1A, but showing the well bore and casing after a displacement plug of the cementing plug assembly has been released and landed on a float collar in the casing.
FIG. 1C is a view similar to FIG. 1B, but showing the well bore and casing after a bottom plug of the cementing plug assembly has been released and landed on the displacement plug.
FIG. 1D is a view similar to FIG. 1C, but showing the well bore and casing after a top plug of the cementing plug assembly has been released and landed on the bottom plug.

Referring now to the drawings and particularly to FIGS. 1A–1D, a well cementing plug assembly of the present invention is illustrated and generally designated by the numeral 10. The plug assembly 10 is shown positioned within a string of casing 12 which is suspended in a well bore 14 preparatory to being cemented therein. The plug assembly 10 is in its initial position in the casing 12 whereby it is releasably connected to the lower end of a string of drill pipe or a conventional circulation tool 16. The casing 12 includes a conventional float collar 24 connected therein near the bottom thereof. A conventional float shoe 32 is connected to the bottom end of the casing 12 separated from the float collar 24 by a distance 30.

The cementing plug assembly 10 is basically comprised of a selectively operable displacement plug 18 which is releasably connected to a selectively operable bottom cementing plug 20. The bottom cementing plug 20 is in turn releasably connected to a top cementing plug 22. The top cementing plug 22 is releasably connected to the drill pipe or circulation tool 16.

The displacement plug 18 and bottom cementing plug 20 are both separately closed and released by dropping different sizes of releasing plugs, e.g., balls, therein and then increasing the differential fluid pressures exerted on the plugs to predetermined differential fluid pressures which cause their release as will be described further hereinbelow. When the displacement plug 18 lands on the float shoe 24 and when the bottom plug 20 lands on the displacement plug 18, the plugs are separately caused to open. That is, the displacement and bottom plugs are opened by again increasing the differential fluid pressures exerted on them to predetermined differential fluid pressures. The top cementing plug 22 is also closed and released by dropping a releasing plug, e.g., a drill string or tubing plug, therein and exerting a predetermined differential fluid pressure thereon.

Referring now specifically to FIGS. 1B–1D, the methods of the present invention will be described. As previously mentioned, both the casing 12 to be cemented and the well bore 14 are usually filled with drilling fluid prior to commencing primary cementing operations. After suspending the casing string 12 in the well bore 14 and positioning the cementing plug assembly 10 within the casing 12 as shown in FIG. 1A, a releasing plug of a predetermined relatively small size (not shown) which will be described in greater detail hereinbelow is dropped into and caused to be moved in a known manner through the drill string or circulation tool 16, through the plug assembly 10 and into the displacement plug 18. The releasing plug closes the displacement plug 18 and a first predetermined differential fluid pressure is then exerted on the displacement plug 18 which causes its release from the assembly 10. A first displacement fluid, such as drilling fluid, is pumped behind the closed displacement plug so that the displacement plug is moved through the casing and lands on the float collar 24 as shown in FIG. 1B. The displacement plug 18 slidably and sealingly engages the walls of the casing 12 as it is moved through the casing and it separates and prevents mixing of the fluids on its opposite sides, i.e., drilling fluid 26 below the displacement plug 18 which was in the casing prior to the release of the displacement plug 18 and the first displacement fluid 28 above the displacement plug 18. As the displacement plug 18 is moved through the casing 12, the quantity of the first displacement fluid being pumped is measured by a volume meter, a pump stroke counter or other volume measurement device whereby when the displacement plug 18 lands on the float collar 24, the total quantity of displacement fluid required to move the displacement plug 18 from the assembly 10 to the float shoe is known.

As is well known to those skilled in the art, when the displacement plug 18 lands on the float collar 24, the movement of the displacement plug 18 and the flow of the first displacement fluid is stopped whereby the pressure within the casing 12 above the displacement plug 18 is increased. Such pressure increase is seen in the displacement fluid pressure indicated at the surface whereby the drilling rig operator knows the displacement plug 18 has landed and can then observe or otherwise determine the total quantity of the first displacement fluid pumped. Thereafter, the first displacement fluid pressure is increased by continued pumping until a second predetermined differential fluid pressure is reached which opens the displacement plug 18 in a manner which will be described hereinbelow.

As described above, a length 30 of the casing 12 extends between the float collar 24 and the float shoe 32 attached to the bottom end of the casing 12. As previously mentioned, the length of casing 30 between the float collar 24 and the float shoe 32 is known in the art as the shoe track and will be referred to hereinafter as the shoe track 30. During the travel of the displacement plug 18 from the assembly 10 to the float collar 24, the drilling fluid 26 below the displacement plug 18 is displaced through the float collar 24, through the shoe track 30 and through the float shoe 32 into the annulus 34 between the casing 12 and the walls of the well bore 14. Once the displacement plug 18 has landed on the float collar 24, the total quantity of the first displacement fluid pumped has been measured and the displacement plug 18 has been opened, a second releasing plug of a predetermined medium size as compared to the first releasing plug is dropped into the bottom cementing plug 20 whereby the bottom cementing plug 20 is closed. A cement slurry 36 is then pumped through the drill string or circulation tool 16 whereby a third predetermined differential fluid pressure is exerted on the bottom cementing plug 20 and it is released. The cement slurry 36 is pumped into the casing 12 behind the bottom plug 20 in a predetermined quantity required to fill the annulus 34. As the bottom plug 20 moves through the casing 12, the first displacement fluid 28 is displaced through the displacement plug 18, through the float collar 24, through the shoe track 30, through the float shoe 32 and into the annulus 34. The cement slurry 36 is pumped, and if necessary displaced, into the casing 12 until the bottom plug 20 lands on the displacement plug 18 as shown in FIG. 1C. The pumping or displacement of the cement slurry 36 is then continued to increase the fluid pressure exerted on the bottom cementing plug 20 until a fourth predetermined differential fluid pressure is reached which causes the bottom cementing plug 20 to open and the cement slurry 36 to flow through it, through the displacement plug 18, through the float collar 24, through the shoe track 30, through the float shoe 32 and into the annulus 34.

When the predetermined quantity of cement slurry 36 has been pumped into the casing 12, a third releasing plug of a predetermined large size as compared to the second releasing plug is dropped into the top cementing plug 22 which closes the top cementing plug 22. A second displacement fluid 38, which preferably is the same as or at least has very similar properties to the first displacement fluid 28 used, is pumped behind the top cementing plug 22. The fluid pressure exerted on the top cementing plug 22 by the second displacement fluid 38 is increased to a fifth predetermined differential fluid pressure which causes the top cementing plug 22 to be released. Thereafter, a quantity of the second displacement fluid 38 substantially equal to the previously measured quantity of the first displacement fluid 28 is pumped. The pumped quantity of the second displacement fluid 38 is preferably measured using the same flow meter or other measuring device which was used to measure the quantity of the first displacement fluid thereby assuring that the two quantities are the same or substantially the same.

The cement slurry 36 is displaced through the casing 12, through the bottom cementing plug 20, through the displacement plug 18, through the float collar 24, through the shoe track 30 and through the float shoe 32 into the annulus 34 as shown in FIG. ID. When the top cementing plug 22 lands on the bottom cementing plug 20, the top cementing plug terminates the flow of the second displacement fluid 38 and prevents it from flowing into the shoe track 30 or the annulus 34. The pumping of the measured quantity of the second displacement fluid 38 allows the rig operator to know that the top plug 22 has landed whereupon the operator can proceed to pressure test the casing 12 and associated equipment. The cement slurry 36 in the annulus 34 and the shoe track 30 is then allowed to set whereby the casing 12 and shoe track 30 are cemented in the well bore. Thereafter, the displacement plug 18, the cementing plugs 20 and 22, the internals of and set cement in float collar 24, the set cement in the shoe track 30 and the internals of and set cement in the float shoe 32 are all drilled out of the casing 12 whereupon the well is completed or additional well bore is drilled below the casing 12.

In accordance with the present invention, the quantity of the second displacement fluid 38 utilized for displacing the top cementing plug 22 and the cement slurry 36 through the casing 12 and into the annulus 34 is a quantity substantially equal to the quantity of the first displacement fluid 28 measured when the displacement plug 18 was displaced through the casing 12 with the first displacement fluid 28. The first and second displacement fluids are preferably the same or very similar fluids, e.g., drilling fluid, and are preferably measured by the same flow meter or other measuring device to ensure as much as possible that the quantities of the first and second displacement fluids are equal or at least substantially equal. Thus, the quantity of the second displacement fluid 38 required to displace the cement slurry 36 into the annulus 34 and land the top cementing plug 22 is positively determined.

By utilizing the methods of this invention, a rig operator is assured of an accurate determination of the quantity of second displacement fluid 38 required and that the cement slurry 36 will not be under displaced or over displaced in the annulus 34. This in turn allows the operator to eliminate or at least drastically shorten the shoe track 30 utilized at the bottom of the casing string as well as the amount of excess set cement required to be drilled out of the casing 12.

As will be understood by those skilled in the art, some operators may prefer to omit the use of the bottom cementing plug 20, and instead utilize a two plug assembly consisting of the displacement plug 18 and the top cementing plug 20. Also as will be understood, the displacement plug and one or two cementing plugs used can be released from the surface separately in any suitable manner and do not necessarily need to be releasably connected in an assembly as described above.

Figure 2:
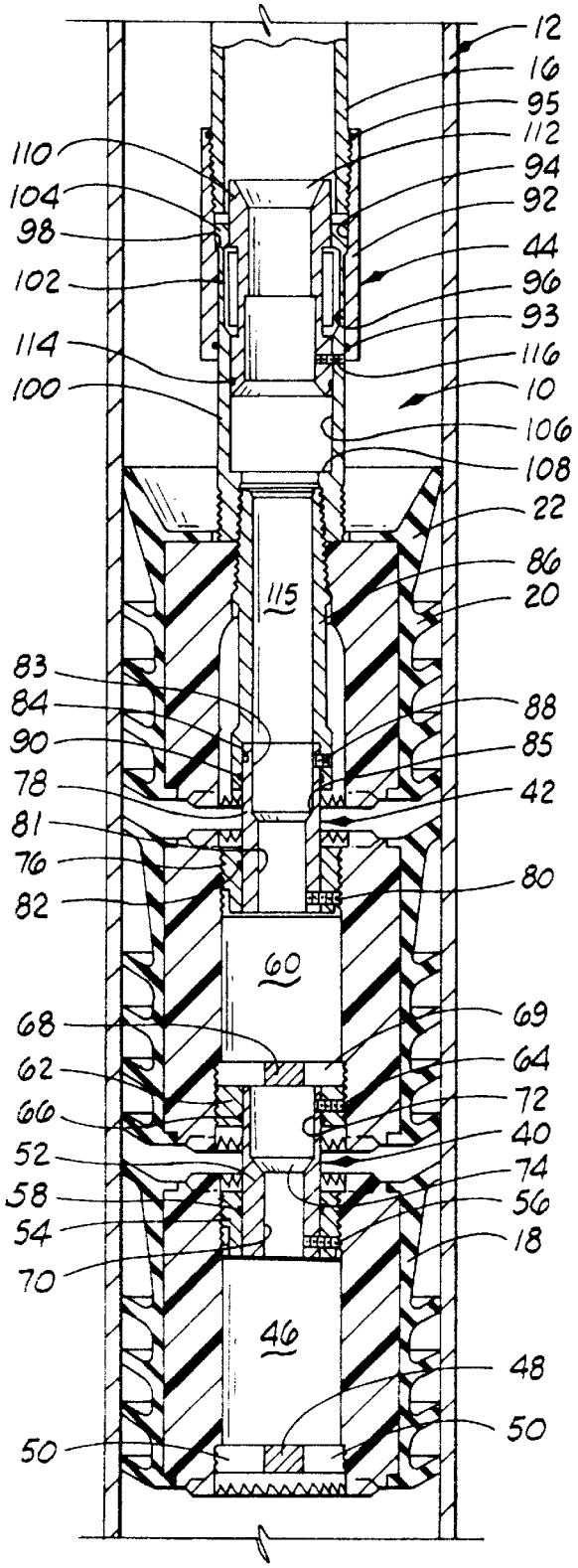
FIG. 2 is an enlarged side cross-sectional view of the cementing plug assembly of FIG. 1.
Figure 3:
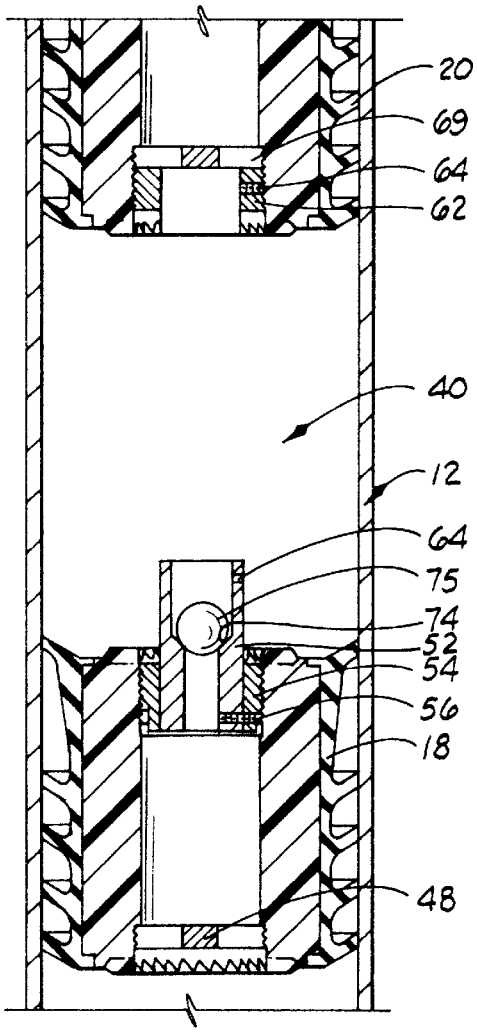
FIG. 3 is a partial side cross-sectional view similar to FIG. 2 illustrating the displacement plug of the cementing plug assembly after it has been released.
Figure 4:
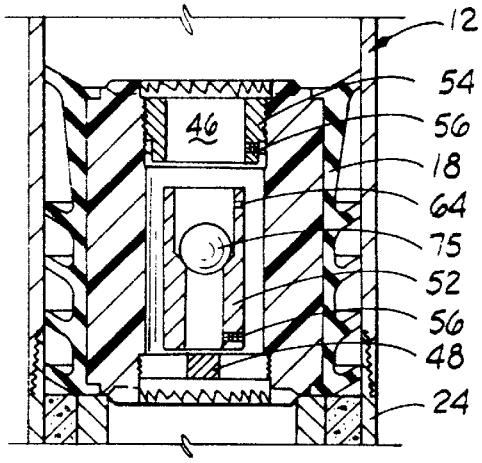
FIG. 4 is a side cross-sectional view similar to FIG. 3 illustrating the displacement plug after it has landed on a float collar or the like and opened.

Referring now to FIGS. 2–4, the cementing plug assembly 10 is illustrated in detail. The assembly 10 is comprised of the displacement plug 18 which is releasably connected to the bottom cementing plug 20 by a differential fluid pressure activated releasing and opening assembly 40. The bottom cementing plug 20 is releasably connected to the top cementing plug 22 by a differential fluid pressure activated releasing and opening assembly 42 which is of the same design as the assembly 40. The top cementing plug 22 is releasably connected to the drill string or circulation tool 16 by a differential fluid pressure activated releasing assembly 44.

The displacement plug 18 includes an internal passageway 46 extending therethrough. A catcher plate 48 having openings 50 therethrough is attached within the passageway 46 of the displacement plug 18 at the lower end thereof and the differential fluid pressure activated releasing and opening assembly 40 is attached within the upper end of the passageway 46. The releasing and opening assembly 40 is comprised of a sleeve 52 which interconnects between the displacement plug 18 and the bottom cementing plug 20. That is, a threaded insert 54 is threadedly connected within the passageway 46 of the displacement plug 18 and the sleeve 52 slidably extends into the insert 54. At least one shear pin 56 is connected between the sleeve 52 and the insert 54. The shear pin 56 is sized so that it shears when the above mentioned second predetermined differential fluid pressure required to open the displacement plug 18 is exerted between the insert 54 and the sleeve 52. The insert 54 also includes an annular groove containing a seal ring, both designated by the numeral 58, for providing a seal between the insert 54 and the sleeve 52.

The bottom cementing plug 20 includes an internal passageway 60 extending therethrough, and an insert 62 is threadedly connected within the passageway 60 at the lower end of the top cementing plug 20. The top end of the sleeve 52 slidably extends within the insert 62 and is attached thereto by at least one shear pin 64 extending between the insert 62 and the sleeve 52. The shear pin 64 is sized so that it shears at the above mentioned first predetermined differential fluid pressure required to release the displacement plug 18 which is lower than the second predetermined differential fluid pressure required to shear the shear pin 56. The insert 62 includes an annular groove containing a seal ring, both designated by the numeral 66, for providing a seal between the insert 62 and the sleeve 52. The bottom cementing plug 20 also includes a catcher plate 68 having openings 69 therein threadedly connected in the passageway 60 above the insert 62. The sleeve 52 includes a small diameter bore 70 and a larger diameter counter bore 72 which form a tapered seating surface 74 for receiving a small size closing plug, e.g., the ball 75 shown in FIGS. 3 and 4.

The predetermined differential fluid pressure activated releasing and opening assembly 42 interconnecting the bottom plug 20 and the top plug 22 is essentially the same as the above described assembly 40. That is, the bottom plug 20 includes an insert 76 threadedly connected within the passageway 60 thereof. A sleeve 78 is slidably disposed within the insert 76, and at least one shear pin 80 is connected between the insert 76 and the sleeve 78. The shear pin 80 is sized so that it shears when the above mentioned fourth predetermined differential fluid pressure required to open the displacement plug 20 is exerted between the insert 76 and the sleeve 78. An annular groove containing a seal ring, both designated by the numeral 82, is disposed in the insert 76 for providing a seal between the insert 76 and the sleeve 78.

The upper end of the sleeve 78 extends into an internal recess 84 in a tubular member 86 which extends through and is threadedly connected to the top cementing plug 22. A shear pin 88 is connected between the tubular member 86 and the sleeve 78 which is sized so that it shears when the above mentioned third predetermined differential fluid pressure required to release the bottom plug 20 is exerted between the sleeve 78 and the tubular member 86. The differential pressure at which the shear pin 88 shears is lower than the differential pressure at which the previously described shear pin 80 shears. The shear pins 80 and 88, however, shear at a higher differential pressure than the previously described shear pins 56 and 72. An annular groove containing a seal ring, both designated by the numeral 90, is disposed in the tubular member 86 for providing a seal between it and the sleeve 78. Like the sleeve 52 of the assembly 40, the sleeve 78 of the assembly 42 includes a small diameter bore 81 and a larger diameter counter bore 83 which form a tapered seating surface 85 for receiving a medium size closing plug (not shown).

The third differential fluid pressure activated releasing assembly 44 interconnected between the top cementing plug 22 and the drill string or circulation tool 16 includes a coupling 92 threadedly connected to the drill string or circulation tool 16. The portion of the coupling 92 below the threads thereof includes an internal bore 94 and a second larger internal bore 96 which form a beveled shoulder 98 in between. A collet 100 which is threadedly connected to the top of the tubular member 86 of the top cementing plug 22 extends into the coupling 92. The upper end of the collet 100 includes a plurality of collet fingers 102 connected to head portions 104. The head portions 104 of the collet 100 are engaged and retained by the beveled shoulder 98 in the coupling 92. The collet 100 includes an internal bore 106 which forms an upwardly facing shoulder 108 at the lower end thereof. Thus, the top plug includes an internal opening 115 extending therethrough which is provided by the coupling 92, the collet 100, and the tubular member 86.

A releasing sleeve 110 is slidably disposed within the collet 100 which includes an internal annular seat 112 at the top end thereof for receiving a large size releasing plug (not shown). The releasing sleeve includes an annular groove containing a seal ring, both designated by the numeral 114, disposed therein for providing a seal between it and the internal bore 106 of the collet 100. As will be understood by those skilled in the art, in the position illustrated in FIG. 2, the releasing sleeve 110 keeps the head portions 104 of the collet fingers 102 engaged with the beveled shoulder 98 of the coupling 92. The coupling 92 includes an annular groove containing a seal ring, both designated by the numeral 93, disposed therein for providing a seal between it and the outside surfaces of the collet 100. A second annular groove containing a seal ring, designated by the numeral 95, is disposed in the coupling 92 for providing a seal between it and the drill string or circulation tool 16. At least one shear pin 116 is connected between the collet 100 and the releasing sleeve 110 whereby the releasing sleeve 110 is held in the upper collet retaining position shown in FIG. 2. The shear pin 116 is sized so that it shears when the previously mentioned fifth predetermined differential fluid pressure required to release the top plug 22 is exerted on the releasing sleeve 110. The differential fluid pressure at which the shear pin 116 shears is higher than the differential fluid pressure at which the previously described shear pin 80 shears. When the shear pin 116 shears the releasing sleeve 110 moves to a lower position whereby the bottom end thereof engages the upwardly facing shoulder 108 of the collet 100 and the heads 104 of the collet fingers 102 disengage from the coupling 92 whereby the top plug is released.

Thus, the well cementing plug assembly 10 of the present invention is connected to a string of drill pipe or a circulation tool 16 and is used for cementing a string of casing which includes a float collar and/or a float shoe in a well bore. The assembly 10 basically comprises a top cementing plug 22 connected to the drill pipe or circulation tool 16 which has an internal opening 115 extending therethrough and is selectively releasable from the drill pipe or circulation tool 16 when a closing releasing plug of a predetermined large size is dropped into the top cementing plug 22 and a predetermined differential fluid pressure is exerted thereon.

A bottom cementing plug 20 is releasably connected to the top cementing plug 22 which also has an internal opening 60 extending therethrough. The bottom cementing plug 20 is selectively releasable from the top cementing plug 22 when a closing releasing plug of a predetermined medium size is dropped into the bottom cementing plug 20 and a first predetermined differential fluid pressure is exerted on the bottom cementing plug. The bottom cementing plug 20 is also selectively openable to allow the passage of fluids therethrough when a second predetermined differential fluid pressure is exerted thereon.

A displacement plug 18 is releasably connected to the bottom cementing plug 20 having an internal opening 46 extending therethrough. The displacement plug 18 is selectively releasable from the bottom cementing plug when a closing releasing plug 75 of a predetermined small size is dropped into the displacement plug 18 and a first predetermined differential fluid pressure is exerted on the displacement plug 18. The displacement plug 18 is also selectively openable to allow the passage of fluids therethrough when a second predetermined differential fluid pressure is exerted thereon.

Referring now to FIGS. 3 and 4, the operation of the displacement plug 18 and the first differential fluid pressure activated releasing and opening assembly 40 attached thereto is illustrated. When the small size releasing plug 75 (shown in the form of a ball) is dropped into the assembly 10, it passes through the assembly 10 into engagement with the tapered seating surface 74 in the sleeve 52 whereby the opening in the sleeve 52 is closed. Thereafter, a first predetermined differential fluid pressure is exerted on the displacement plug 18, i.e., between the closed sleeve 52 and the insert 62, whereby the shear pin 64 is sheared. The shearing of the shear pin 64 releases the displacement plug 18 as illustrated in FIG. 3.

When the displacement plug lands on the float collar 24 as shown in FIG. 4 and the second predetermined differential fluid pressure is exerted thereon, i.e., between the insert 54 attached to the displacement plug 18 and the closed sleeve 52, the shear pin 56 is sheared. The shearing of the shear pin 56 allows the closed sleeve 52 to move downwardly out of engagement with the insert 54 to a position where it is held within the displacement plug 18 by the catcher plate 48 as illustrated in FIG. 4. The downward movement of the closed sleeve 52 opens the passageway 46 through the displacement plug 18 whereby fluids are free to flow through the displacement plug 18.

The bottom cementing plug 20 and the differential fluid pressure activated releasing and opening assembly 42 interconnected between it and the top cementing plug 22 function in the same way as the above described displacement plug 18 and the assembly 40 except that a medium sized releasing plug (not shown) is dropped into the sleeve 78 of the assembly 42. A first predetermined differential fluid pressure is then exerted on the bottom cementing plug 20, i.e., between the tubular member 86 of the top cementing plug 22 and the closed sleeve 78, to shear the shear pin 88 and release the cementing plug 20. When the cementing plug 20 lands on the displacement plug 18, a second predetermined differential fluid pressure is exerted on the bottom cementing plug 20, i.e., between the closed sleeve 78 and the insert 76, to cause the cementing plug 20 to be opened in the same manner as described above for the displacement plug 18.

When a large size releasing plug (not shown) which can be in the form of a ball, a tubing plug or the like, is dropped into the releasing assembly 44 of the top cementing plug 22, it closes the releasing sleeve 110. When a predetermined differential fluid pressure is exerted on the closed releasing sleeve 110, it is moved downwardly whereby the top cementing plug 22 is released as previously described.

As is well understood by those skilled in the art, the displacement plug utilized in accordance with this invention can be released from the surface or from a sub-surface position into the casing to be cemented using any of a variety of known techniques and hand or mechanically operated equipment. Also, only one cementing plug in addition to the displacement plug can be utilized.

A variety of cementing plug assemblies which include two cementing plugs, i.e., a bottom cementing plug releasably interconnected to a top cementing plug which is in turn releasably connected to a drill pipe or circulation tool, have been developed and used heretofore. Such two cementing plug assemblies have included various mechanisms for closing, releasing and then opening the cementing plugs during a primary cementing operation, all of which are well known to those skilled in the art. While a presently preferred plug assembly 10 of the present invention including two cementing plugs and a displacement plug has been described above, numerous changes in the design and arrangement of the various parts of the assembly as well as to the various steps of the methods of this invention can be made by those skilled in the art, which changes are encompassed within the spirit of this invention as defined by the appended claims.

What is claimed is:

1. A method of cementing a string of casing disposed in a well bore which includes a float collar connected near the bottom end thereof comprising the steps of:

(a) releasing a closed displacement plug into said casing which is selectively openable after landing on said float collar;

(b) pumping a first displacement fluid behind said closed displacement plug while measuring the quantity of said first displacement fluid being pumped until said displacement plug is displaced through said casing and lands on said float collar;

(c) causing said displacement plug to open;

(d) pumping a cement slurry into said casing in a predetermined quantity required to fill the annulus between the exterior of said casing and the walls of said well bore with said cement slurry; and (e) releasing a top cementing plug into said casing and pumping a second displacement fluid behind said top cementing plug to displace said cement slurry through said casing and through said open displacement plug into said annulus, said second displacement fluid being pumped in a quantity substantially equal to the quantity of said first displacement fluid as measured in accordance with step (b) thereby ensuring that said cement slurry is not under or over displaced in said annulus.

2. The method of claim 1 which further comprises the steps of releasing a closed but selectively openable bottom cementing plug into said casing after causing said displacement plug to open in accordance with step (c) and before said cement slurry is pumped in accordance with step (d) and causing said bottom cementing plug to open after it lands on said displacement plug.

3. The method of claim 1 wherein said first and second displacement fluids are fluids having the same or similar properties.

4. The method of claim 1 wherein said first and second displacement fluids are portions of the drilling fluid used for drilling said well bore.

5. The method of claim 1 wherein said string of casing includes a float shoe connected at the bottom end thereof and a length of casing between said float collar and said float shoe to provide additional protection against over displacing said cement slurry in said annulus.

6. The method of claim 2 wherein said displacement plug, said bottom cementing plug and said top cementing plug are releasably connected in an open tubular assembly, and said method further comprises connecting said assembly to a string of drill pipe or a circulation tool disposed within the top of said string of casing prior to performing step (a).

7. The method of claim 6 wherein said displacement and cementing plugs are separately closed and released by dropping releasing plugs therein and exerting predetermined differential fluid pressures thereon.

8. The method of claim 2 wherein said displacement plug and said bottom plug are caused to open by exerting predetermined differential fluid pressures thereon.

9. A method of cementing a string of casing disposed in a well bore which includes a float collar connected near the bottom end thereof comprising the steps of:

(a) releasing a closed displacement plug into said casing, said plug opening and allowing the passage of fluids therethrough when a predetermined differential fluid pressure is exerted on said plug;

(b) pumping a first displacement fluid behind said closed displacement plug while measuring the quantity of said first displacement fluid being pumped until said displacement plug is displaced through said casing and lands on said float collar;

(c) continuing said pumping of said first displacement fluid until the differential fluid pressure exerted on said displacement plug increases to said predetermined differential fluid pressure whereby said displacement plug opens;

(d) releasing a closed bottom cementing plug into said casing which opens at a higher predetermined differential fluid pressure than said displacement plug after landing on said displacement plug and pumping and displacing a cement slurry behind said bottom cementing plug in a predetermined quantity required to fill the annulus between the exterior of said casing and the walls of said well bore with said cement slurry;

(e) continuing said pumping or displacing of said cement slurry when said bottom cementing plug lands on said displacement plug to increase the differential fluid pressure on said bottom cementing plug to said higher predetermined differential fluid pressure whereby said bottom cementing plug opens; and (f) releasing a top cementing plug into said casing and pumping a second displacement fluid behind said top cementing plug while measuring the quantity of said second displacement fluid to displace said cement slurry through said casing, through said open bottom cementing plug and through said open displacement plug into said annulus, said second displacement fluid being pumped in a quantity substantially equal to the quantity of said first displacement fluid as measured in accordance with step (b) thereby ensuring that said cement slurry is not under or over displaced in said annulus.

10. The method of claim 9 wherein said first and second displacement fluids are fluids having the same or similar properties.

11. The method of claim 9 wherein said first and second displacement fluids are portions of the drilling fluid used for drilling said well bore.

12. The method of claim 9 wherein said string of casing includes a float shoe connected at the bottom end thereof and a length of casing between said float collar and said float shoe to provide additional protection against over displacing said cement slurry in said annulus.

13. The method of claim 9 wherein said displacement plug, said bottom cementing plug and said top cementing plug are selectively and releasably connected in an open tubular assembly, and said method further comprises connecting said assembly to a string of drill pipe or a circulation tool disposed within the top of said string of casing prior to performing step (a).

14. The method of claim 13 wherein said displacement and cementing plugs are separately closed and released by dropping releasing plugs therein and exerting predetermined differential fluid pressures thereon.

15. The method of claim 9 wherein said quantities of said first displacement fluid and said second displacement fluid are measured in accordance with steps (b) and (f), respectively, by the same volume measuring device.

16. The method of claim 9 wherein said quantities of said first displacement fluid and said second displacement fluid are measured in accordance with steps (b) and (f), respectively, by a displacement fluid pump stroke counter.

* * * * *